United States Patent [19]

Rotrekl et al.

[11] 4,402,347

[45] Sep. 6, 1983

[54] WARP LET-OFF AND ITS DRIVE IN A LOOM

[75] Inventors: Otto Rotrekl, Brno; Vladimir Kuda, Blazovice, both of Czechoslovakia

[73] Assignee: Vyzkumny a vyvojovy ustav Zavodu vseobecneho strojirenstvi, Brno, Czechoslovakia

[21] Appl. No.: 254,155

[22] Filed: Apr. 14, 1981

[30] Foreign Application Priority Data

Apr. 3, 1980 [CS] Czechoslovakia ..... 3033-80

[51] Int. Cl.[3] ..... D03D 49/06; D03D 49/20

[52] U.S. Cl. ..... 139/99; 139/110; 139/304

[58] Field of Search ..... 139/99, 97, 100, 110, 139/304, 308; 66/209, 211

[56] References Cited

U.S. PATENT DOCUMENTS

| | | | |
|---|---|---|---|
| 2,820,485 | 1/1958 | Selles | 139/99 |
| 3,308,854 | 3/1967 | Pfarrwaller | 139/99 |
| 3,677,305 | 7/1972 | Cutting et al. | 139/99 |
| 3,878,872 | 4/1975 | Hintsch | 139/99 |
| 3,934,620 | 1/1976 | Garcia | 139/99 |
| 4,125,131 | 11/1978 | Porter | 139/99 |

FOREIGN PATENT DOCUMENTS

| | | | |
|---|---|---|---|
| 2656145 | 10/1977 | Fed. Rep. of Germany | 139/110 |

*Primary Examiner*—James Kee Chi

[57] ABSTRACT

A loom capable of weaving a wide variety of cloths, the loom requiring at most the simple exchange of gears to permit it to weave cloths of widely varying characteristics. The loom has an input driving element for the warp beam let-off motion which is drivingly connected with the output element of an adjustable transmission mechanism of the let-off motion drive, while the input element of the adjustable transmission element of the let-off motion drive is drivingly connected with the transmission mechanism of the positive drive of the cloth take-up beam. The input element of the adjustable transmission of the let-off motion drive is drivingly connected with the output element of the transmission mechanism of the positive drive for the take-up beam, the take-up beam being also drivingly connected with such output element. The adjustable transmission mechanism of the let-off motion consists of a plurality of serially connected gears, for example three, the first such gear being the output element, the third such gear being the input element, and the second, intermediate, gear being located rotatably on a carrier which is mounted for swinging on a fixed part of the loom about the axis of rotation of the first or the third gear with which it is in constant mesh, either the first or the third gear being exchangeable.

2 Claims, 2 Drawing Figures

WARP LET-OFF AND ITS DRIVE IN A LOOM

Figure 1:
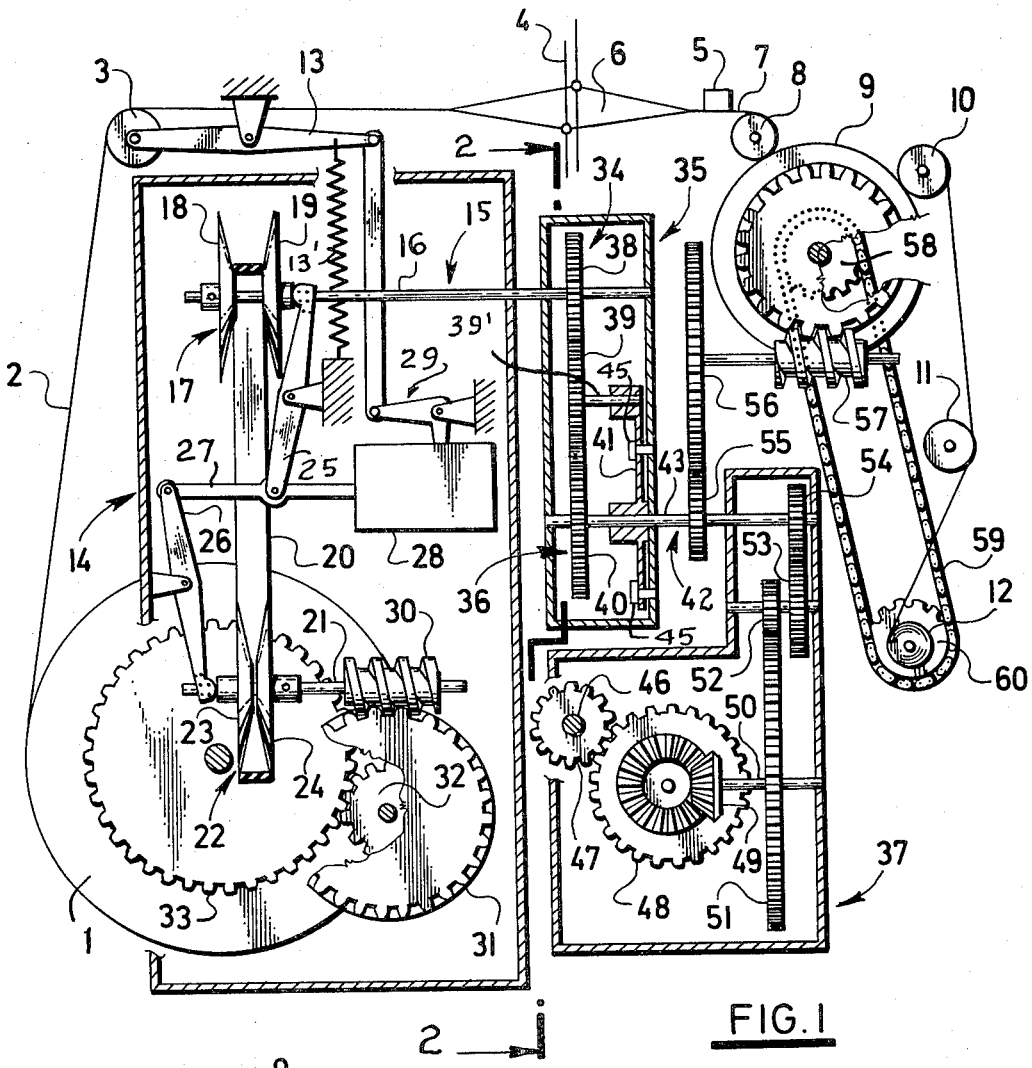

This application relates to the co-assigned application Ser. No. 247,646, filed Mar. 26, 1981 by the same inventors.

This invention relates to an improvement in looms. Known looms are provided with weft insertion mechanisms, shedding mechanisms, etc., together with a positively driven take-up beam taking-up the cloth by friction, and with a warp beam with wound-on warp threads. The warp beam is usually driven through a let-off motion, which responds to a change in the tension of the warp threads being let-off by a change in the speed of revolution of the warp beam. The take-up beam is positively driven through a transmission mechanism from the drive for the loom. The let-off motion of the warp beam and the take-up beam are independently drivingly connected to the loom drive, usually to the main shaft thereof.

With such prior looms there is the disadvantage that the speed of warp threads let-off is not satisfactorily related to the speed of cloth take-up, and thus it is necessary to set up the warp threads let-off and the cloth take-up for every selected weft setting, both before starting the loom and during weaving. This causes a reduction of the productivity of the loom, more work for the loom operator, and reduction of the quality of the cloth produced by the loom.

A loom is also known wherein the input driving shaft of the let-off motion of the warp beam is fixedly connected with a gear in the transmission which positively drives the take-up beam. In this case, the relation of the speed of rotation of the take-up beam and the speed of rotation of the input driving shaft of the let-off motion always have the same ratio with respect to each other. When the positive drive transmission for the take-up beam is reset according to an intended weft setting, the speed of rotation of the input shaft of the let-off motion of the warp beam drive will be changed in the same manner. The disadvantage of the last described arrangement lies particularly in the specially high demands for the range of adjustment of the let-off system when weaving cloths with denser weft settings, and consequently with higher longitudinal contraction, or with lower weft settings and consequently with reduced longitudinal contraction.

The above-mentioned disadvantages of the prior art are overcome by the loom according to the present invention. In accordance with the present invention, the input driving element of the warp beam let-off motion drive is adjustably drivingly connected with the output element of the adjustable transmission mechanism for the let-off motion drive, while the input element of the adjustable transmission mechanism of the let-off motion drive is drivingly connected with the transmission mechanism which positively drives the take-up beam.

Further, in accordance with the invention, the input element of the adjustable transmission of the let-off motion drive is drivingly connected with the output element of the transmission mechanism which positively drives the take-up beam.

In accordance with a preferred embodiment of the invention, the adjustable transmission mechanism of the let-off motion drive consists of three gears, the first such gear being the output element, the third gear being the input element, and the second, intermediate gear, being located rotatably on a carrier which is mounted adjustably for swinging on a fixed part of the loom frame around the axis of rotation of the first gear or of the third gear with which it is in constant mesh, while the third or the first gear is exchangeable.

The main advantage of the loom according to the present invention is, first of all, the widening of the possibility of production by the loom of cloths with dense or, to the contrary, with loose weft setting, and thus consequently with increased or reduced longitudinal cloth contraction, respectively, with reduced demands for the range of let-off activity of the let-off of the warp beam drive.

Figure 2:
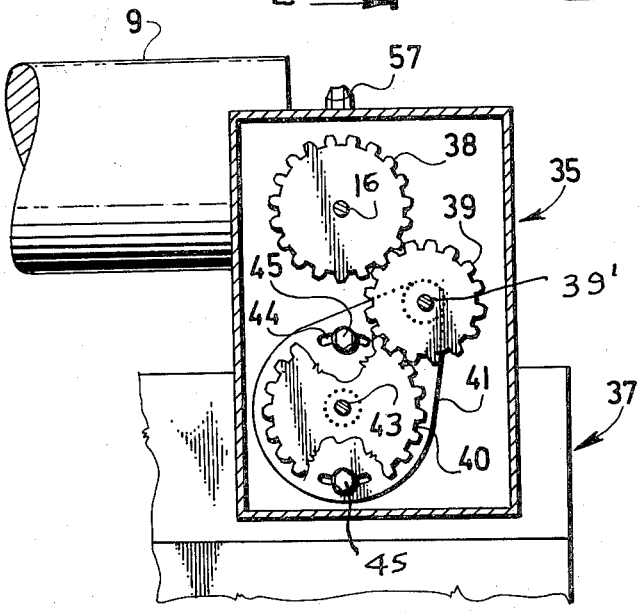

An examplary embodiment of the invention is illustrated in the accompanying drawings, wherein:

FIG. 1 is a schematic illustration of a loom provided with the present invention, the view being partially in elevation and partially in section; and FIG. 2 is a view partially in elevation and partially in section of a portion of the apparatus shown in FIG. 1, the section being taken along the line 2—2 in FIG. 1.

The loom has a frame, not shown, in which there is rotatably mounted a warp beam 1. On the warp beam 1 there are wound warp threads 2 which are fed to a back-rest cylinder 3. The backrest cylinder 3 is rotatably mounted on swingable levers of which one is shown at 13, the levers being spring-loaded by a coil tension spring 13'. In passing over the back-rest cylinder 3, the warp threads urge the levers 13 counter-clockwise against the opposition of the spring 13'. It can thus be seen that the cylinder 3 and the levers 13 respond to changes in tension in the warp threads 2 by changing their position. After passing the cylinder 3, the warp threads pass to a system of healds 4 through which they travel toward a temple 5, against which the weft threads being inserted into the shed 6 are beaten up by a reed (not shown). Downstream of the temple 5 the cloth 7 is led over a first pressure roll 8 onto a take-up beam 9, and from such beam the cloth passes over a second pressure roll 10 and a supporting roll 11 to be taken-up by a second, final cloth beam 12.

Warp beam 1 is driven by means of a let-off motion 14 which responds to the change of tension in the warp threads 2 by changing the speed of rotation of the warp beam 1. The basic part of the let-off motion 14 shown is a known belt type infinitely variable drive (PIV) having a satisfactory range of speed variation. The input driving element 16 for the let-off motion 14 is specifically an input driving shaft 15. A first part 17 of the upper pulley of the let-off motion 14 has one part 18 which is fixedly mounted on the shaft 16, such upper pulley being completed by a disc 19 which confronts disc 18 and is slidably mounted upon the shaft 16. On a second, lower shaft 21 of the let-off motion 14 there is disposed a second, lower pulley 22 which has one part 23 thereof slidably mounted upon shaft 21, and the second part 24 thereof affixed to the shaft 21. Such upper and lower pulleys are connected by a V-belt 20. The slidable pulley parts or discs 19 and 23 are under the control of two first-class levers 25 and 26 which are pivotably mounted on the frame of the loom. The upper end of lever 25 and the lower end of lever 26 engage its respective slidable disc 19, 23, the other ends of levers 25 and 26 being connected through a tie-rod 27, such tie-rod also being connected with a let-off element 28 which may, for example, have the same construction as let-off element 5 shown and described in the above referred to other application Ser. No. 247,646 filed by the same inventors. Let-off element 28 is connected with levers 13 through a link which extends the ends of levers 13 remote from back-rest cylinder 3 and a bell crank lever connected to element 28. Element 28 can advantageously have a proportionally integrational behavior. The second, lower shaft 21 of the let-off motion 14 drives the warp beam 1 through a worm 30 affixed to the shaft 21, a worm gear 31 which meshes with the worm 30 and a pinion 32 affixed to the worm gear 31 and meshing with the gear 33 which is fixedly attached to the warp beam 1.

Drive shaft 16 of the let-off motion 14 is drivingly connected with the output element 34 of the mechanism 35 of the adjustable transmission for driving the let-off motion 14. The input element 36 of mechanism 35 is drivingly connected with the positive drive 37 for the take-up beam 9.

Mechanism 35 for driving the adjustable transmission of the let-off motion 14 in this exemplary embodiment is made up of a gear train consisting of three serially connected gears 38, 39, and 40, of which at least one of such gears, for example, gear 38, may be exchanged in order to change the speed ratio between the shafts 43 and 16. In order to maintain a driving relationship between gears 40 and 38 when gears 38 of different diameters are employed, there is provided an arrangement which is more fully shown in FIG. 2. The intermediate gear 39 is mounted for rotation on a carrier 41 which is swingably mounted on the wall of the housing for the adjustable transmission 35. Such housing is affixed to the frame (not shown) of the loom. Carrier 41 is mounted for limited rotation about the axis of the shaft 43 and of the gear 40. Thus the carrier 41 is provided with a plurality (two shown) of arcuate slots 44 coaxial of the shaft 43, machine screws 45 passing through the slots 44 and being threaded into the housing of the transmission 35. Gear 38 forms a part of the output element 34, whereas gear 40 forms a part of the input element 36 of the adjustable mechanism 35 for driving the warp beam 1. The shaft 43 is thus the output element 42 of the positive drive transmission 37 for the take-up beam 9.

Mechanism 37 contains a gear 47 which is fixedly mounted on the main shaft 46 of the loom. Gear 47 meshes with a larger gear 48 to which there is fixedly mounted a first bevel gear 49. Gear 49 meshes with a second bevel gear 49' affixed to a shaft 50 to which there is affixed a first spur gear 51 which is in mesh with a smaller gear or pinion 52 affixed to a shaft on wnhich another, larger gear 53 is fixedly secured. Gear 53 meshes with another gear 54 affixed to the shaft 43. Thus the main shaft 46 of the loom drives the shaft 43 and thus the gear 40 in synchronism therewith.

In order to change the speed of rotation of the take-up beam 9 with respect to the speed of rotation of the main loom shaft 46, some or all of the gears 51 to 54, incl., may be changed in a known manner. In the embodiment shown, the drive for the take-up beam 9 is from the distribution shaft 43 through two meshing gears 55 and 56 and a worm 57 meshing with a worm wheel affixed to the take-up beam 9. On the end of the take-up beam 9 and secured thereto, there is a sprocket 58 which is drivingly connected to a sprocket 60 bearing the cloth beam 12 by a chain 59. The cloth beam 12 is coupled to the sprocket 60 by a selectively operated friction clutch (not shown).

The above described embodiment of the apparatus of the invention operates as follows:

During the operation of the loom, the warp threads 2 are continuously unwound from the warp beam 1 and as long as there is no disproportion between the speed of let-off of the warp threads and the take-up of the woven cloth, the detector, i.e., the backrest cylinder 3, remains at a fixed, set-up position and the angular velocity of the warp beam 1 is constant because the tie-rod 27 of the let-off element 28 of the motion 14 of the drive for the warp beam 1 is at rest. In case of a change of tension of the warp threads 2, the back-rest cylinder 3 changes its position. This change of the position of the cylinder 3 is transmitted through the tie-rod and bell crank lever combination 29 into the let-off element 28. This results in a change of the position of the tie-rod 27 which shifts the movable discs 19, 23 of the pulleys 17, 22, respectively, accordingly thereby to effect the required change in the speed of rotation of the warp beam 1. After returning the tension of the warp threads 2 to the previous predetermined value, the changed speed of rotation of warp beam 1 remains at its adjusted value, and the back-rest cylinder 3 returns to its original, setup position until a following change of tension of the warp threads 2, when the above process is repeated. It is to be noted that the let-off element is of a proportionally integrational character.

It is to be noted that the speed of rotation of the input driving shaft 15 of the let-off motion 14 bears a fixed relationship to the speed of rotation of the take-up beam 9 with a given set-up of the gears 38, 39, 40 and the gears 51, 52, and 53. With a sufficient range of adjustment of the let-off motion 14 for driving the warp beam 1, it is possible to produce in the loom the majority of current types of fabrics even without resetting the mechanism 35 of the adjustable transmission for driving the let-off motion 14. Of course, cloth with a warp setting above 90 and with under three threads per centimeter because of higher or lower values of the longitudinal contraction of the warp threads cannot be woven in this way, and the transmission in mechanism 35 of the adjustable transmission of the drive for the let-off motion 14 must be changed. This is carried out simply, as by replacing gear 38 with a larger or smaller gear according to the selected weft setting in the cloth and according to the value of the longitudinal contraction of the warp threads. In this way, weaveability within the whole package of warp threads 2 on the warp beam 1 is secured without the necessity of an additional adjustment when weaving all kinds of cloths.

Although the invention is illustrated and described with reference to one preferred embodiment thereof, it is to be expressly understood that it is in no way limited to the disclosure of such preferred embodiment but is capable of numerous modifications within the scope of the appended claims.

We claim:

1. In a loom having a main shaft, means for forming a shed, a warp beam, the warp beam being driven through a let-off motion responding by a change of the speed of rotation of the warp beam to the change of tension of the warp threads traveling toward the shed, a transmission means driven by the main shaft, the let-off motion having an input-driving element which is drivingly coupled with the transmission means so as to be positively driven by it, and a driven take-up beam for taking-up the cloth produced during operation of the loom, the improvement comprising means including said transmission means positively drivingly connected between the input element and the take-up beam to drive the input-driving element and the take-up beam in synchronism, and means for selectively changing the ratio between the speeds of driving of the input element and the take-up beam.

2. A loom according to claim 1, wherein the mechanism of the transmission of the let-off motion drive comprises at least three serially drivingly connected gears of which the first gear is positively driven in synchronism with the main shaft of the loom, the third gear is the input element of the let-off motion, and the second, intermediate gear is mounted rotatably on a carrier which is pivotally mounted on a fixed part of the loom to rotate about the axis of rotation of one of the said first and third gears with which it is in constant mesh, one of the first and third gears being exchangeable.

* * * * *